United States Patent [19]

Morris

[11] 4,026,079

[45] May 31, 1977

[54] SHORING SCAFFOLD CONSTRUCTION

[75] Inventor: Ronald G. Morris, Beaver Falls, Pa.

[73] Assignee: Beaver-Advance Corporation, Ellwood City, Pa.

[22] Filed: Oct. 3, 1975

[21] Appl. No.: 619,529

[52] U.S. Cl. ..... 52/122; 52/646; 85/8.3; 182/179; 248/354 P; 403/21; 403/49; 403/109; 403/379

[51] Int. Cl.² ..... E04H 12/18

[58] Field of Search ..... 52/632, 637, 638, 645, 52/646, 122, 126; 182/178, 179; 403/49, 108, 109, 174, 175, 187, 189, 242, 284, 378, 379, 12, 21; 211/182; 248/354 P, 354 R; 85/5 CP, 5 N, 8.3; 254/7 R, 13

[56] References Cited

UNITED STATES PATENTS

| | | | |
|---|---|---|---|
| 1,552,333 | 9/1925 | Mosher | 52/638 |
| 2,435,171 | 1/1948 | Weisz | 52/646 |
| 2,449,069 | 9/1948 | Harrison | 52/122 |
| 2,481,885 | 9/1949 | Simpson | 403/49 X |
| 2,757,002 | 7/1956 | Ryden | 403/109 X |
| 3,059,888 | 10/1962 | Lie | 403/109 |
| 3,084,761 | 4/1963 | Robertson | 182/178 |
| 3,190,405 | 6/1965 | Squire | 52/122 |
| 3,313,081 | 4/1967 | Squire | 182/178 |
| 3,347,003 | 10/1967 | Lapp | 52/632 X |
| 3,693,309 | 9/1972 | Kutchai | 52/646 |
| 3,874,802 | 4/1975 | Lindsey | 403/405 X |

FOREIGN PATENTS OR APPLICATIONS

| | | | |
|---|---|---|---|
| 114,575 | 1/1940 | Australia | 52/632 |
| 1,356,174 | 2/1964 | France | 85/8.3 |
| 42,245 | 12/1959 | Poland | 52/632 |
| 408,382 | 9/1966 | Switzerland | 248/354 P |
| 21,124 | 1903 | United Kingdom | 52/122 |
| 1,148,656 | 4/1969 | United Kingdom | 403/379 |

*Primary Examiner*—Alfred C. Perham
*Attorney, Agent, or Firm*—Parmelee, Miller, Welsh & Kratz

[57] ABSTRACT

A skeletonized, adjustable, high-rise scaffold assembly employs stacked sections, each made-up of a pair of opposed end frames or panels. The end frames of cooperating upper and lower sections are each provided with a pair of main or outer, supporting side legs and retained latching pin means for vertically adjustably connecting the sections together. Side legs of each end frame have a pin connector extending inwardly within a plane of the frame to removably receive ends of cross brace members that are mounted to extend from an end frame of one section diagonally across in a connected relation with an opposed end frame of the other section. The cross brace members have spaced-apart latching hole portions at at least one of their ends to enable a selection of a proper hole portion that is related to or compatible with an up or down adjustment of the frames of an upper section with respect to frames of a cooperating lower section. In one embodiment, the section bracing connections are made between inner or secondary leg members of the opposed frames, and in another embodiment, the connections are between main or outer leg members of the opposed frames.

4 Claims, 22 Drawing Figures

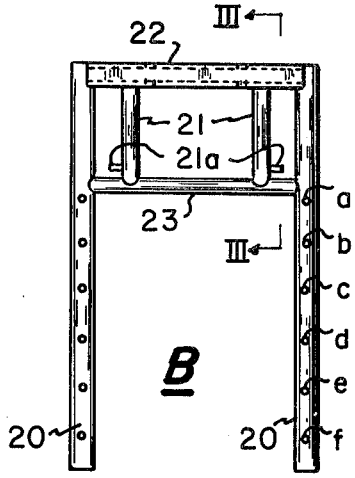
Fig. 2
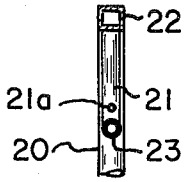
Fig. 3
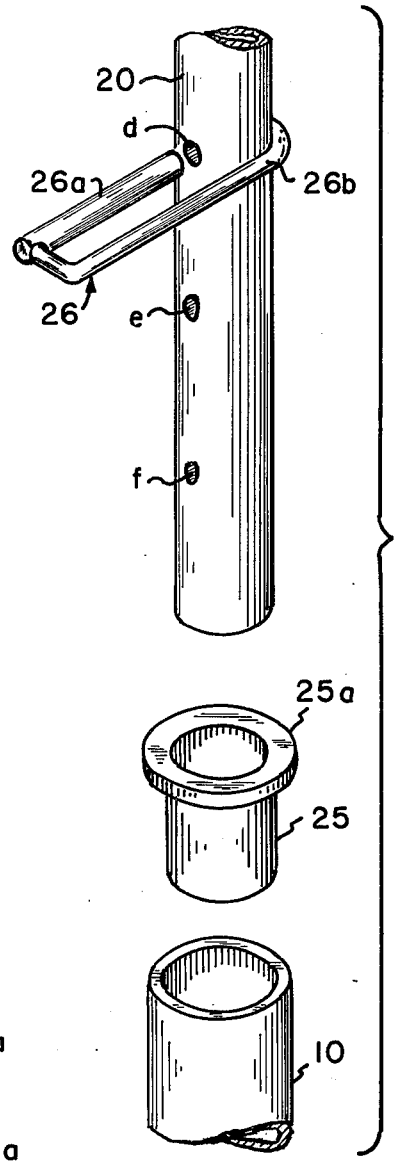
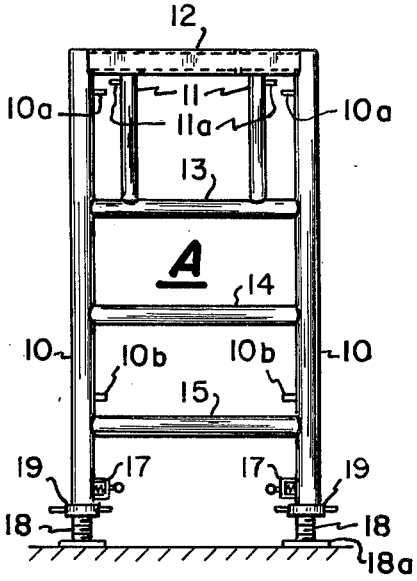
Fig. 1
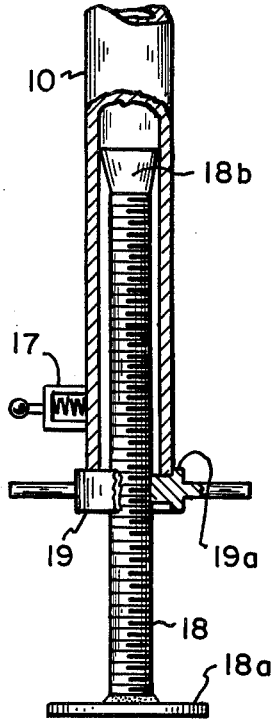
Fig. 4
Fig. 5
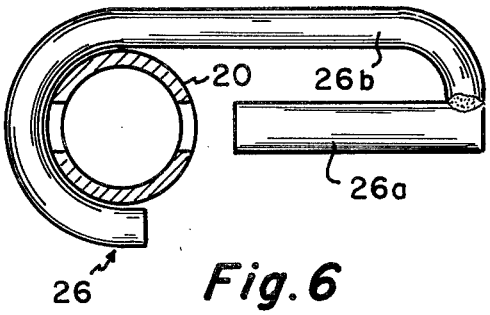
Fig. 6
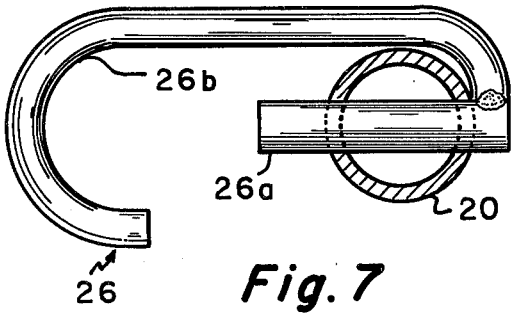
Fig. 7

SHORING SCAFFOLD CONSTRUCTION

BACKGROUND OF THE INVENTION

1. Field of the Invention

This invention pertains to a scaffolding or shoring having interfitting high-rise sections that are provided with diagonal bracing members that are proportioned in their effective end-connected relations to adjusted vertical positions between stacked sections across which they are connected. The invention particularly relates to an improved sectional scaffolding that is simplified and strengthened in its construction and utilization, and that facilitates adjusted positioning of upper and lower sections with respect to each other.

2. Description of the Prior Art

Skeletonized adjustable so-called high-rise scaffolding or shoring has taken many forms throughout the years and generally employs tubular or hollow members in order to assure strength with relative lightness for transportation and handling. It has been customary to provide sections in which outer or main leg members of, for example, an upper section are endwise-telescoped within upper ends of aligned outer leg members of a lower section. It has also been customary to provide spaced holes along outer leg members of an upper or telescoping section for the purpose of providing a somewhat rough vertical adjustment between the two sections, depending upon the required overall heighth of the assemly. Also, adjustable feet have been used with outer legs of the lower section of a scaffold assembly to provide finer adjustments as to the overall heighth. Various arrangements have been used in connecting opposite end frames of a section with each other and with those of a vertically adjacent section. There however has been a need for a simplified and improved cross connecting structure which will provide a scaffold with maximum strength and rigidity in utilization, and at the same time, which will minimize weight and facilitate mounting and adjustment of one section, for example, an upper section with respect to a lower section.

SUMMARY OF THE INVENTION

It has thus been an object of the present invention to devise a skeletonized adjustable high-rise scaffold unit which simplifies the connecting of an end frame or panel of one section with an opposed end frame or panel of a cooperating section and in such a way as to improve rigidity and strengthen the assembly, and to make the unit easily adaptable from the standpoint of its cross bracing to heighth adjustments between its sections.

Another object of the invention has been to provide a scaffold assembly which employs improved means for adjustably cross-connecting end panels of frames of one section with opposite end frames of another section, and that may also be interchangeably used for connecting opposed end panels or frames of the same section together.

A further object of the invention has been to provide a strong scaffold panel or end frame construction of minimized weight that is adaptable for use with various types of connectors employed between endwise-stacked outer legs of scaffold sections.

A still further object of the invention has been to provide improved accessories for ajusting and retaining upper and lower scaffold sections in their positioning with respect to each other.

These and other objects of the invention will appear to those skilled in the art from the illustrated embodiments and the claims.

BRIEF DESCRIPTION OF THE DRAWINGS

In the drawings,

FIG. 1 is a greatly reduced end view in elevation showing an end frame of a lower scaffolding section of the invention in an upright position;

FIG. 2 is a vertical view in elevation on the same scale as FIG. 1 and showing an end frame of an upper or extension section of a scaffolding construction of the invention and which may be interfitted or stacked with a base or lower end frame to build up a scaffold;

FIG. 3 is a vertical fragmental section on the scale of and taken along line III-III of FIG. 2;

FIG. 4 is a greatly enlarged detail in elevation, partially in section, illustrating the mounting and construction of an adjustable foot jack that may be used, as shown, with the base frame of FIG. 1;

FIG. 5 is a further enlarged, exploded vertical perspective in elevation illustrating a clip-like latching pin element and collar assembly that may be used in connecting outer side legs of end frames of upper and lower sections in an adjustably assembled telescopic relation, such as illustrated in FIG. 8;

FIGS. 6 and 7 are horizontal details showing, on an enlarged scale with respect to FIG. 5, the construction and utilization of the latching pin element of FIG. 5 in unlatched and latched mounted positions with respect to an outer leg of the scaffolding; FIG. 6 particularly illustrates a fully unlatched but retained positioning of the element, while FIG. 7 shows a fully latched positioning; the position of FIG. 6 permits the element to be moved along an outer leg of a scaffolding end frame to a suitable cross-extending hole therein;

DESCRIPTION OF THE PREFERRED EMBODIMENTS

Figure 8:
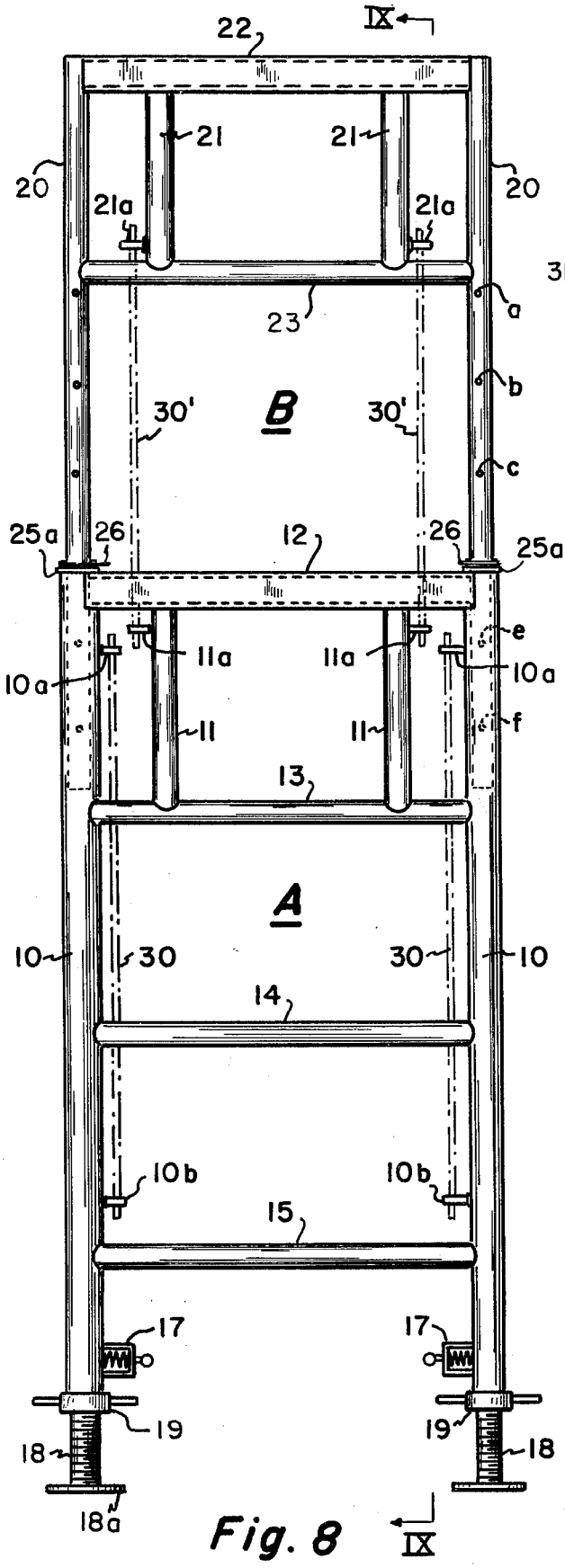
FIG. 8 is a vertical end view in elevation, on an intermediate scale with respect to FIGS. 1 and 4, showing upper and lower scaffold frames in a fully assembled or erected relationship with respect to each other.

FIG. 8 shows a representative scaffold assembly embodying the invention which employs a lower, skeletonized, substantially rectangular-shaped section A and an upper cooperating, adjustable, skeletonized, substantially rectangular-shaped section B. Each section A and B, as indicated in FIGS. 1 and 2, has a pair of upright, opposed end frames or panels of identical construction from the standpoint of its own section. In this connection, section A has a pair of opposed, upright, sidewise spaced-apart, end sections or panels defined by a pair of spaced-apart outer or columnar main legs 10, and section B has a pair of opposed, upright, sidewise spaced-apart, end frames or panels defined by a pair of spaced-apart outer or main legs 20.

The pair of spaced-apart, upright, outer columnar legs 10 are shown of tubular metal construction, provided with open upper and lower end portions. Each end frame of the lower section A has a pair of integrally connected, inner, shortened-length, vertically positioned, spaced-apart, inner or secondary, tubular legs 11 that lie substantially within the plane of the outer legs 10, and that are secured at their lower ends to an integrally connected, upwardly positioned, cross-extending, horizontal strut cross-tie or spacer member 13, also shown of tubular construction. An integral, upper spacer cross-tie or girt member 12 of rectangular section not only cooperates with member 13 to space the pair of outer legs 10 with respect to each other and with respect to the pair of inner legs 11, but also with the member 13 and outer legs 10 defines an end frame of rectangular shape. The members 11, 12 and 13 define an inner frame of rectangular shape. An integral, centrally disposed, cross spacer or strut member 14 and an integral lower, cross spacer or strut member are integrally connected between the pair of outer legs 10 to provide strongly reinforced end frames for the lower section A.

Figure 9:
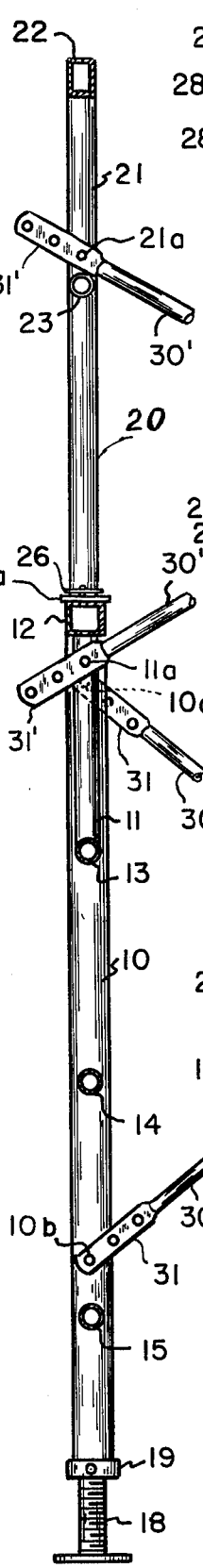
FIG. 9 is a side view in elevation on the scale of and taken along the line IX—IX of FIG. 8; in this figure, side-mounted, end frame connecting, removable cross braces for upper and lower scaffold sections have been broken away and their connected relationship with respect to inner and outer leg members is illustrated.
Figure 12:
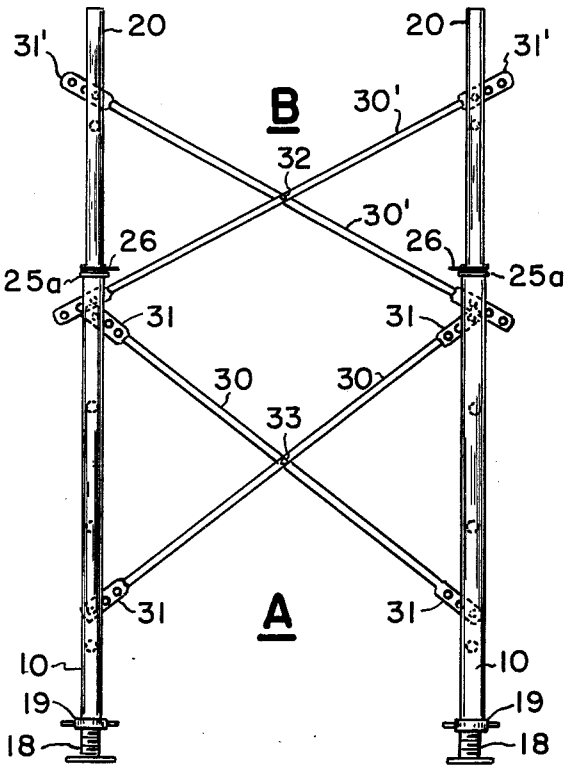
FIG. 12 is a skeletonized side view in elevation on a reduced scale or upper and lower sections of the scaffold assembly of FIG. 8; it particularly illustrates the use and mounting of removable cross braces for connecting end frames of a lower or base section together and for connecting end frames of an extension or upper section to opposite end frames of the lower section; this view shows the frames of the extension section in a lower positioning with respect to the frames of the base section at which cross braces that are connected between upper and lower frames of the sections (dual tier) have their innermost latching hole portions positioned on latching or connector pins.

Each outer leg 10 of the frames of the section A has a pair of integral, inwardly projecting, latching or connector pins 10*a*, 10*b* that are mounted thereon adjacent to upper and lower end portions thereof. On the other hand, each inner leg 11 is provided with an integral, upwardly positioned, connector or latching pin 11*a* that projects outwardly therefrom and also, like pins 10*a* and 10*b*, within the plane of the frame. The upper connector means 10*a* of the outer legs 10 of one base frame are adapted, as shown in FIGS. 8, 9 and 12, to receive the upper end of a cross brace member 30, and the lower connector means 10*b* of the opposite base frame of the same section A is adapted to receive the lower end of the same cross brace member 30. Each side of the lower section A has a pair of diagonal, cross-extending brace members 30 detachably connected between its end frames.

Figure 11:
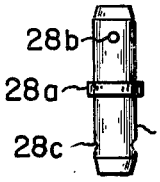
FIG. 11 is a side view in elevation of a stack pin that may be used in connecting side legs of a base or lower section and the side legs of an intermediate section in a representative assembly such as shown in FIG. 10.
Figure 10:
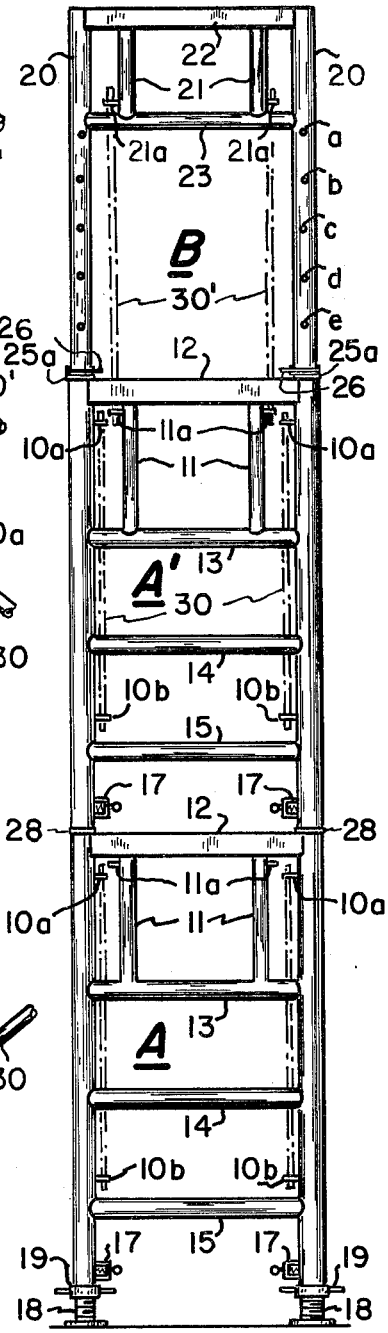
FIG. 10 is a reduced end view in elevation somewhat similar to FIG. 8, but illustrating the use of an intermediate section which corresponds to the base section, for attaining a greater elevation of the scaffold.

Although not required for use in positioning an adjustable screw type of foot jack 18, each leg 10 is shown provided with a spring-pressed latching pin assembly 17 that may be employed to enter an upper hole 28*b* in and retain a stack pin 28 (see FIG. 11) in position when, as shown in FIG. 10, a second base section A′ is to be stacked on a lower section A to provide additional heighth to an assembly. The pin 28 has through-extending holes 28*b* and 28*c*, either of which may receive the pin of the latching assembly 17; a central flange 28*a* is adapted to rest between the adjacent ends of the legs 10 of the two base type of sections A and A′.

FIG. 4 is illustrative of the adjustable jack type of foot unit 18 whose threaded stem terminates at one end in a frusto-conical-shaped, beveled head portion 18*b* and, at its other end, in a plate-like foot portion 18a. The head portion 18b is adapted to serve as an aligning and guide means for the upper end of the stem when it is introduced into pivotal-sliding engagement with the inner wall of the open, lower end of an outer leg 10 in the mannner shown in FIGS. 1 and 4. It provides a secure and pivotally aligned positioning in combination with an adjustable hand wheel or nut 19 that is mounted on the stem. As shown, the hand wheel 19 has upper and lower cut-out or recessed portions or areas surmounted by a rim edge 19*a* whose inner diameter corresponds to the outer diameter of the leg 10 that is to cooperate therewith. The cut-out or recessed area serves as a bearing for the end wall of the leg 10, the rim portion 19a serves as a retention means for the end of the leg, and in cooperation with the foot portion 18*a*, maintains the jack in a centrally aligned position with respect to the leg. Adjustment of the hand wheel 19 by rotating it on the threaded stem of 18 enables a relatively fine heighth adjustment. As shown, the threaded stem has a spaced or loose positioning within its associated leg to thus permit pivotal aligning movement of the stem about the head portion 18*b*. Thus, slight variations in floor or ground level may be compensated to assure that the scaffolding not only has the proper heighth, but to assure that all four legs of its lower section A have a fully aligned and stable positioning on the floor or ground upon which the foot plates 18*a* rest.

The section B, shown in FIGS. 2 and 8, is particularly suited for use as an upper section, in that each of its opposed upright end frames or panels has a pair of outer, tubular metal legs 20 that are of slightly smaller diameter than corresponding legs 10 of the pair of opposed end frames of the lower section A. A sliding telescopic relation may be maintained between the cooperating legs 10 and 20 when the sections are stacked or assembled in an upright, connected-together relation. Like those of the lower section A, the end frames of the upper section B have an upper, cross-extending integral hollow strut cross-tie or spacer member 22 of hollow rectangular section that integrally connects the outer pair of legs 20. Each end frame also has an integral, intermediately positioned, cross-extending strut cross-tie or spacer member 23 of tubular construction integrally connected between the outer legs 20. The member 23 is connected to the strut 22 by a pair of integral, vertical, spaced-apart, relatively short-length, inner or secondary legs 21, also of metal tubular construction. Each inner leg 21 is shown provided with a connector or latch pin 21*a* near its lower end that projects sidewise therefrom and within a plane defined by the pair of outer side leg members of each end frame of the upper section B.

The upper and lower sections B and A may be assembled and maintained in a suitable, adjusted position with respect to each other through the agency of means shown in FIGS. 5 to 7. This means may include a cup-like, hollow, short-length, reinforcing insert element 25 that is adapted to fit slidably within the upper open end of an associated outer, lower leg 10 to slidably receive the lower end of an associated outer, upper leg 20; it is provided with an upper, position-retaining stop flange 25*a* thereabout that is adapted to rest on the upper edge of the lower leg 10. The cup element 25 has an inner diameter that substantially corresponds to the outer diameter of an associated upper outer leg 20, and has an outer diameter that substantially corresponds to the inner diameter of an associated outer lower leg 10 to provide a relatively close, slide-fitting relation. Intermediately positioned cup 25 minimizes friction involved in moving the leg members 20 within their associated members 10 when adjusting the heighth of the upper section B with respect to lower section A and, at the same time, provides a stop for a position-retaining latch or clip pin element 26.

The actual latched relationship between cooperating upper and lower outer legs 20 and 10 is accomplished through the agency of the position-retaining latch element or latchaing pin means of U-shaped integral construction 26. As shown particularly in FIGS. 5 to 7, the element 26 has a solid cylindrical pin-like latching part 26*a* of strong alloy metal that is adapted to extend through an aligned latching hole portion (see *a* to *f*) in an outer leg 20. FIG. 7 shows the retention position; see also FIGS. 8, 9 and 10. At this time, its extending looped arm or clip portion 26*b* rests along with its integral outer pin end portion 26*a* on the flange 25*a* of an associated bearing cup element 25, if used. On the other hand, when it is desired to move the element 26 from one latching hole position to another, see the equally vertically spaced-apart latching hole locations represented as *a* through *f* of FIGS. 2 and 8, then as illustrated particularly in FIG. 6, the pin 26*a* may be withdrawn and the looped arm portion 26*b* may be used as a slide guide while the element 26 is moved to an alternative latching hole position. It will be noted that the position-retaining means or element 26 may be used with or without a cup element 25. However, if the cup element is to be omitted, it is desirable to provide the legs 20 with a slightly enlarged diameter for giving a close slide-fit within the leg 10.

At a new position, the pin portion 26*a* may be slid into the aligned hole portion to the position of FIG. 7. The pin element 26 will be retained on its associated leg 20 when out of its latching or locking position (see FIG. 6), without danger of being lost, for ready usage in assembling a scaffold. The spacing between the end of the pin 26*a* and of the loop portion 26*b* only permits removal of the element 26 endwise of an associated leg 20. Heretofore, it has been necessary to provide a latching pin with a flexible connecting wire or chain or the like in order to retain it and this, of course, tends to give rise to the problem of tangling. It will be apparent that one latching pin element 26 on each of the four outer legs 20 will enable vertical adjustments of section B as to its supported relation on the lower section A by using the latching hole portions *a* to *f*. Summarized, the latching pin means 26 has a pin portion 26*a* which is adapted to endwise-slide into and out of an aligned latching hole portion (see FIGS. 6 and 7) of an associated main leg (such as 20) and, at its outer end, is secured to a retaining arm of U-shape. The arm at its shorter end is sloped or curved from its secure integral connection to the pin portion 26*a* and extends into an intermediate portion that projects backwardly therefrom in a substantially parallel axial relation with respect to the pin portion 26*a*. The other or back end of the arm is curved to define a larger or substantially semi-circular loop portion 26*b* having an inner diameter that substantially corresponds to an outer diameter of an associated main side leg 20. As shown, the terminal end of the loop 26*b* has a spaced relation with an inner end of the pin portion 26*a* that is less than the outer diameter of the associated side leg 20; such restriction of the spacing prevents the latching pin means 26 from being removed other than endwise from the associated leg 20. The length or extent of the intermediate portion is sufficient to permit the pin portion 26*a* to be moved fully into and out of a latching position with respect to the associated leg (see FIG. 6).

FIG. 10 is illustrative of a third section A′ that may be used with sections A and B to further extend the heighth of a scaffold assembly. The section A′, for example, may be positioned as an upper or, as shown, an intermediate section of the assembly. Since it may be identical in construction with respect to the lower base section A, it will function in the same way as section A in adjusting the positioning of an upper section such as B.

Figure 14:
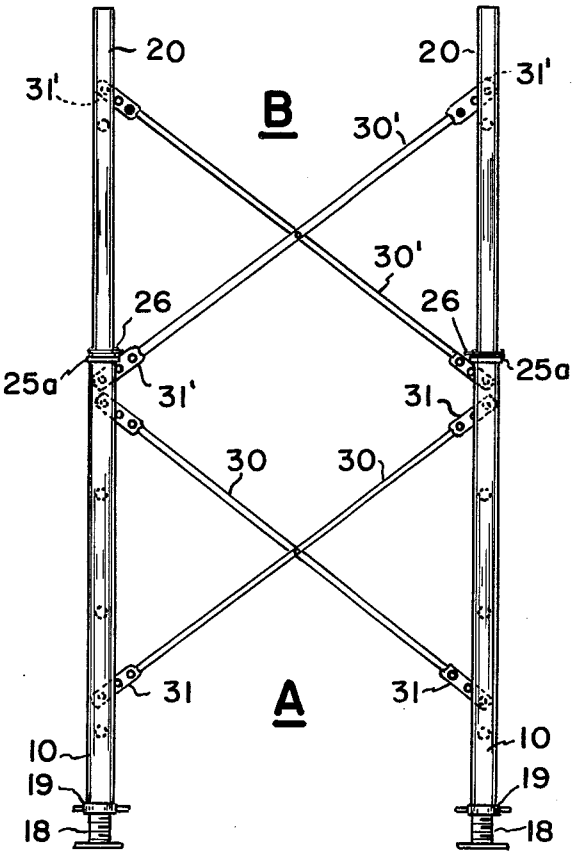
FIG. 14 is an elevation similar to and on the scale of FIGS. 12 and 13, illustrating an uppermost positioning of the extension section with respect to the base section in which outermost latching hole portions of the upper brace members are positioned on the latching or connector pins.
Figure 13:
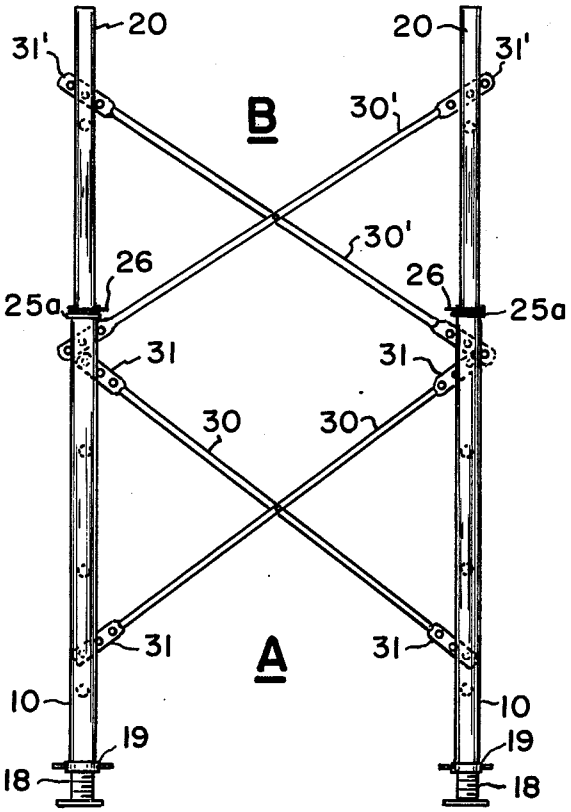
FIG. 13 is an elevation on the scale of and of the same structure as shown in FIG. 12, but showing the end frames of the upper or extension section in a one-notch or slightly raised position with respect to those of the base section, and the utilization of intermediate or second latching hole portions of upper or dual tier cross braces.
Figure 15:
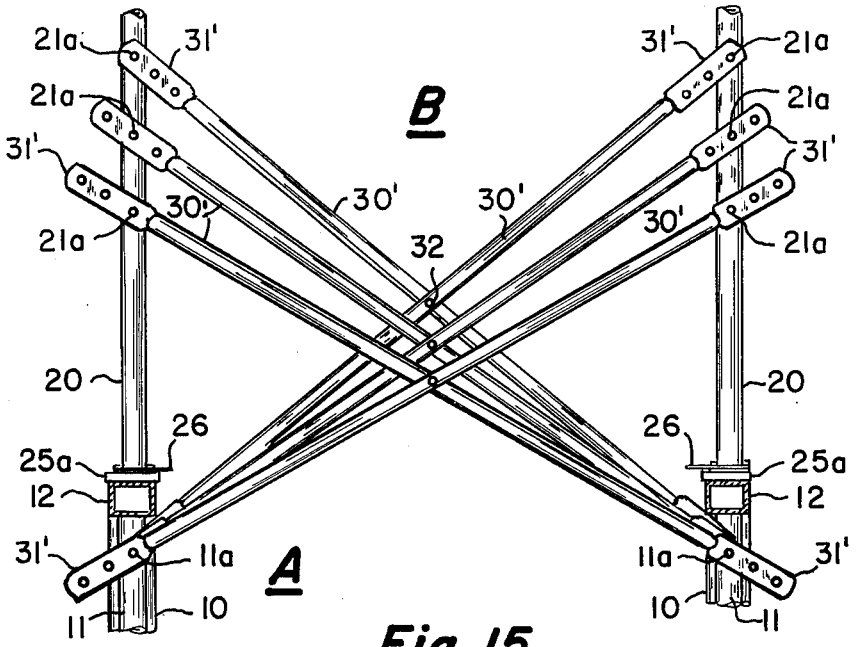
FIG. 15 is a fragmental side view in elevation, on the same scale as FIGS. 8 and 9, further illustrating different positions of upper or dual tier cross braces that connect frames of the extension section with opposite frames of the base section; this view gives a different approach to the showing of the adjustment positions of the brace members to accommodate for three different vertical positions of the extension section and as utilizing brace members such as illustrated in FIGS. 17 and 18.
Figure 16:
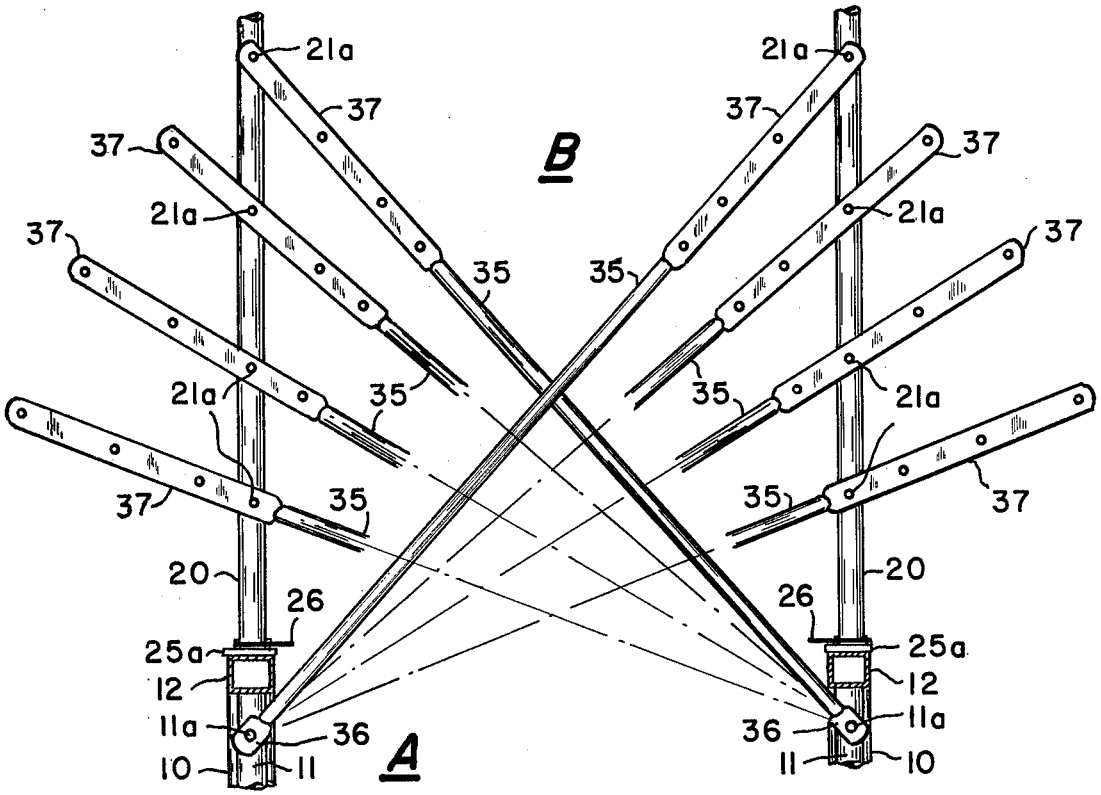
FIG. 16 is a view on the scale of and similar to FIG. 15, but illustrating the utilization of a brace member of the construction shown in FIGS. 21 and 22 which has a group of lengthwise spaced-apart latching slots or hole portions at only one end thereof, but which may alternately be used for accommodating brace member positioning to different height adjustments of the frames of an extension section.

For adjustably connecting leg members of opposite panel or end frames of one section with respect to those of another section (dual tier use), pairs of position-adjustable, criss-crossing, diagonally extending, connecting brace members 30 or 35 are provided. See particularly FIGS. 17 and 21. Each of the brace members is shown of rod-like or tubular construction and as terminating at each of its ends in a flattened connector portion through which at least one mounting hole portion extends, see also FIGS. 18 and 22. Connector brace member 30 of FIGS. 17 and 18 has a pair of flattened end portions 31, each provided with a group of three, spaced-apart, latching hole portions to, as shown in FIG. 15, provide a series of adjustments to correspond with vertical adjustments of upper and lower sections with respect to each other. FIG. 15 is illustrative of adjusted positions of one end of side brace members 30' while the other end is retained at one position. However, for proper proportioned adjustment to vertical adjustments of the side legs of a pair of upper and lower sections and, as illustrated in FIGS. 12 to 14, both ends should be adjusted. As indicated in FIG. 16, the spacing between hole portions is greater where only one end of the side brace members is to be adjusted.

Figure 19:
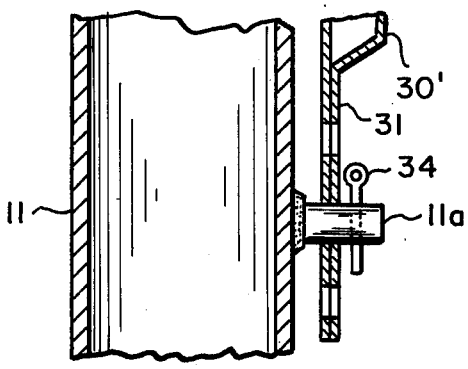
FIG. 19 is a greatly enlarged sectional detail in elevation showing how a brace member such as shown in FIGS. 17 or 21 may be locked or retained in position on a latching pin by a through-extending headed pin or cotter element.
Figure 21:
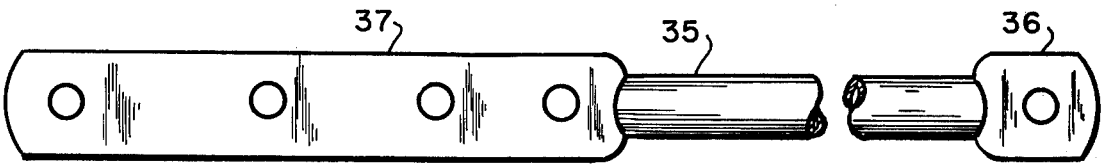
FIG. 21 is a top plan view and FIG. 22 is a side view in elevation of a modified or alternate form of cross brace member. This view is on the same scale as FIGS. 17 and 18.
Figure 22:
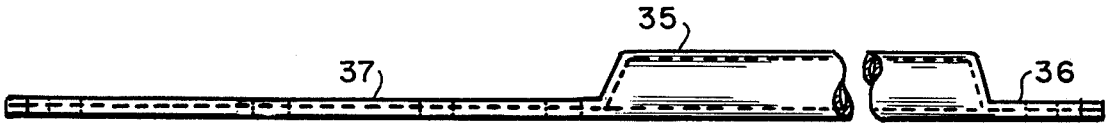

The brace member 35 shown in FIGS. 21 and 22 has one end 37 provided with a group of latching hole portions, but the other end 36 is provided with only one. This also enables vertical heighth adjustment between upper and lower sections as illustrated in FIG. 16. As indicated in FIG. 19, the members may be retained or locked in position on an associated latching pin, such as 11*a*, etc. by a bolt-like, cross-extending element, cotter or key 34 that may be secured by a chain (not shown) connected to its eye-like head to retain it on the member 30 or 35 for ready usage. The cross brace members (30 or 30') are of a standard length whereby they may be used, not only as dual tier connectors 30' between opposite end frames of upper and lower sections B (B'') and A (A', A''), but also interchangeably (see FIG. 12) as single tier connectors 30 between upper latching pins 10*a* of the pair of legs 10 of one end frame of a lower section A and lower latching pins 10*b* of the opposite end frame of the same section.

Figure 20:
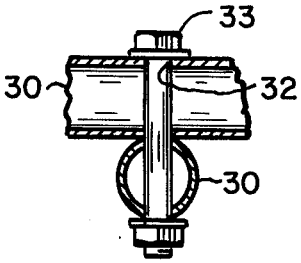
FIG. 20 is a horizontal sectional detail taken through a pair of diagonally extending cross brace members for the base frame, and showing how they may be centrally pivotally connected together to further reinforce the cross-extending brace member assemby.

Each pair of members 30 for a base frame A or A', at their point of crossing, may be pivotally centrally connected together (see FIG. 20) by a nut and bolt pivotal assembly 33 that extends through aligned central hole portions 32 of the crossing members. Since there is no need for adjustment of the two lower pairs of braces, as used exclusively for connecting the pair of end frames of the base section A together, only one hole is needed at the ends of the members. However, to facilitate interchangeability, use is shown of brace members such as 30 (or 30') that are primarily constructed for adjustably connecting the frame of an upper section, such as B, with the opposite frame of a lower section, such as A (or A').

To connect the opposed end frames or panels of upper and lower sections B and A (or A') together, side pairs of diagonally crossing brace members 30 or 35 are utilized. In the embodiment of FIGS. 8 to 10 and 15, the dual tier cross brace members are designated as 30' (rather than 30) and alternative cross brace members of FIGS. 16, 21 and 22 are designated as 35. When the members 30' are used for the upper section B, the connecting assembly 33 of FIG. 20 may be omitted. It will be noted that one end of each brace member 30' is mounted on an upper latching pin 21*a* of an inner or secondary leg 21 of each end frame of the upper section B. The outer end of the same brace member 30' is mounted on an upper latching pin 11*a* of an inner or secondary leg 11 of the opposite frame of the lower section A (or A', see FIG. 10).

Figure 17:
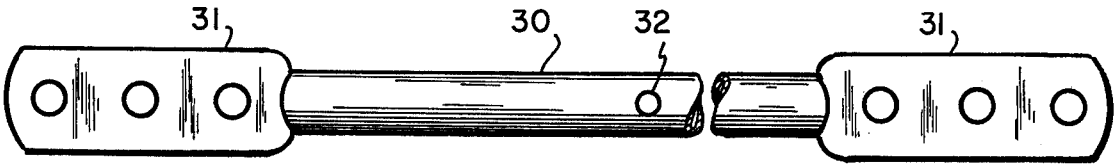
FIG. 17 is an enlarged top plan view and FIG. 18 is a side view in elevation of a form of cross brace member construction such as illustrated in use in FIGS. 12 to 15, inclusive.
Figure 18:
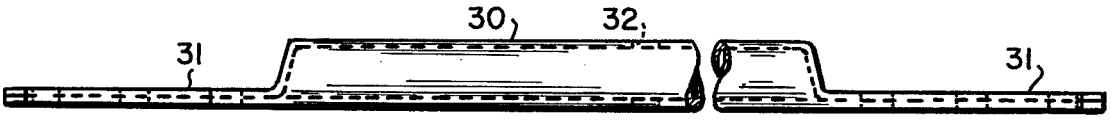

In FIGS. 8 and 10, the outer or main legs 20 of the end frames of the upper section B are shown provided with vertically spaced-apart adjustment holes *a*, *b*, *c*, *d*, *e*, and *f*. Since the reinforcement provided by the brace members 30' (30) will not be required when the upper section B is in about three lower positions, such as represented by the use of the holes *a*, *b*, and *c*, six of the latching holes in the connector end portions 31 of the member of FIGS. 17 and 18 are not essential. The spacing between the hole latching or adjustment portions of each end group in the brace members 30 (30') will be proportioned on a diagonal basis to the vertical spacing between the holes *d* to *e* to *f*, etc. Since the type of member 30 (30') shown in FIGS. 17 and 18 may be simultaneously adjusted at its opposite ends, as indicated in FIG. 12, the spacing between the adjacent holes at its end portions 31 (31') may be of one half the spacing between the adjacent holes at the one end portion 37 of the type of brace member 35 shown in FIGS. 16, 21 and 22.

Although the cross brace members have, for the purpose of illustration, been shown provided with three latching hole portions at both ends thereof (see the members 30 and 30') and with four latching hole portions at one end thereof (see the members 35 and 55), it will be apparent that any suitable number may be employed at one or both ends of the members to suit any particular adjustment requirements. Also, means such as the latching pin shown in FIG. 11 for connecting the outer leg members of scaffold sections in an aligned, telescopic relation is representative. The use of cross braces that are centrally pinned together, shown in FIGS. 12 to 15, gives stability to the scaffold sections and is particularly suitable for use in cross bracing opposed frames of a lower base or supporting section.

I claim:

1. In an adjustable-height high-rise scaffold assembly having upper and lower sections provided with open-end tubular side legs and means for roughly adjusting the vertical position of the legs of the upper section with respect to those of the lower section, an adjustable screw jack having a screw stem to be entered into and removed from a loosely pivotal fit within an open cylindrical end wall of each main side leg of one section to project therefrom, a support member integrally carried by a projecting end of said stem, an internally threaded hand wheel adjustably positioned on said stem and having an inner recessed portion to receive an edge of the open end wall of the associated main side leg for providing a relatively fine adjustment of said leg with respect to said support member, a rim portion about said inner recessed portion to retain the jack in a centrally aligned position with respect to the leg, and a frustoconical beveled guide head secured on an inner end of said screw stem for engaging within the end wall of the associated leg to insert said stem within the associated leg member and facilitate a pivotal alignment and adjustment thereof with respect to the associated main side leg.

2. In an adjustable heighth high-rise scaffold assembly having upper and lower main sections of substantially the same construction, each section being provided by a pair of opposed spaced-apart integral end frames, each end frame being substantially planar and having a pair of spaced-apart tubular upright main side legs, the main side legs of end frames of the upper section having a telescopically interfitting relation with the main side legs of the end frames of the lower section and having vertically spaced-apart latching hole portions and cooperating latching pin means for adjusting their heights with respect to aligned main side legs of the end frames of the lower section, the improvement comprising, a pair of vertically spaced-apart horizontally cross-extending strut members integrally secured between upper end portions of the pair of main side legs of each end frame of both the upper and lower sections, said pairs of strut members defining a substantially planar rectangular-shaped integral upper end portion of each upper and lower section, a pair of shorter length secondary legs positioned in a slightly horizontally inwardly spaced relation with respect to the pair of main side legs of and integrally secured to and extending vertically across between said pair of cross-extending strut members of each end frame of both the upper and lower sections, a latch pin integrally carried by each said secondary leg of each said pair and extending outwardly therefrom in an opposite direction with respect to the latch pin of the other secondary leg of each said pair and within the spacing between each said secondary leg and an adjacent main leg of each end frame of both the upper and lower sections, tubular brace members of a standard length having flattened opposite ends provided with latching hole portions for detachably cooperating with said latch pins of said secondary legs to diagonally cross-connect each end frame of the upper section with an opposite end frame of the lower section, each of said brace members having at least one flattened end thereof provided with a group of longitudinally spaced-apart latching hole portions whose spaced relation is proportioned on a diagonal basis to the vertically spaced relation between the latching hole portions in the main side legs of the end frames of the upper section, whereby said brace members may be accommodated to vertical heighth adjustments of the main side legs of the upper section in their telescopic relation with aligned main side legs of the lower section, said latch pins of the upper and lower end frames that are connected together by the same diagonal brace members extending in the same direction within the plane of their respective end frames, whereby each of said brace members may be inserted on and removed from cooperating pairs of said latch pins within the spacing between adjacent main and secondary legs of the end frames of the upper and lower sections.

3. A scaffold assembly as defined in claim 2 wherein, latch pins project inwardly from upper and lower end portions of the main legs of the end frames of the lower section and within the plane of the associated end frame, standard length tubular brace members at their opposite ends have latching portions for removably cooperating with said latch pins on the main side legs to diagonally detachably cross-connect the upper end portion of each end frame of the lower section with the lower end portion of the opposite end frame thereof, whereby said last-mentioned tubular brace members may be inserted and removed from upper latch pins of one end frame and lower latch pins of the other end frame of the lower section along the inside of associated main side legs of the end frames of the lower section.

4. A scaffold as defined in claim 3 wherein said additional brace members cross each other as pairs along opposite sides of the lower section, and means secures said pairs together at a central point of crossing therebetween.

* * * * *